US010363489B2

(12) United States Patent
Bernard et al.

(10) Patent No.: US 10,363,489 B2
(45) Date of Patent: Jul. 30, 2019

(54) NON-PERMANENT WHITEWATER WATER COURSE

(71) Applicant: HYDROSTADIUM, Annecy (FR)

(72) Inventors: Gilles Bernard, Annecy (FR); Pascal Simon, Annecy (FR)

(73) Assignee: HYDROSTADIUM, Annecy (FR)

( * ) Notice: Subject to any disclaimer, the term of this patent is extended or adjusted under 35 U.S.C. 154(b) by 0 days.

(21) Appl. No.: 15/739,360

(22) PCT Filed: Jun. 24, 2016

(86) PCT No.: PCT/EP2016/064685
§ 371 (c)(1),
(2) Date: Dec. 22, 2017

(87) PCT Pub. No.: WO2016/207360
PCT Pub. Date: Dec. 29, 2016

(65) Prior Publication Data

US 2018/0185760 A1 Jul. 5, 2018

(30) Foreign Application Priority Data

Jun. 26, 2015 (FR) ..... 15 55957

(51) Int. Cl.
*A63G 21/18* (2006.01)
*A63G 31/00* (2006.01)
(Continued)

(52) U.S. Cl.
CPC ..... *A63G 31/007* (2013.01); *A63B 69/06* (2013.01); *A63B 69/08* (2013.01); *A63B 71/023* (2013.01); *A63C 19/00* (2013.01); *A63G 3/00* (2013.01); *A63G 21/18* (2013.01); *A63B 2069/068* (2013.01); *A63B 2210/50* (2013.01); *A63B 2225/09* (2013.01); *A63B 2225/093* (2013.01); *A63C 19/062* (2013.01); *E02B 5/005* (2013.01); *E04H 2004/0068* (2013.01)

(58) Field of Classification Search
CPC . A63G 3/00; A63G 3/06; A63G 21/00; A63G 21/18
USPC ..... 472/13, 116–117, 128–129; 104/69–70
See application file for complete search history.

(56) References Cited

U.S. PATENT DOCUMENTS 4,149,710 A 4/1979 Rouchard
5,137,497 A * 8/1992 Dubeta ..... A63C 19/00 472/117

(Continued)

FOREIGN PATENT DOCUMENTS

CN 202490428 U 10/2012
DE 102007010529 A1 8/2008

(Continued)

*Primary Examiner* — Kien Nguyen
(74) *Attorney, Agent, or Firm* — Dinsmore & Shohl LLP

(57) ABSTRACT

The invention relates to a white-water river, comprising a river bed capable of guiding a current of water between an upper inlet of the bed and a lower outlet of the bed, and including water-feeding means for injecting a stream of water at the upper inlet of the bed. The river bed is made up of a series of individual bed modules, adjacent to one another, and assembled via respective transverse contact surfaces. The individual bed modules are supported via a lower surface by a modular lattice bearing structure.

17 Claims, 4 Drawing Sheets

(51) Int. Cl.

| | |
|---|---|
| ***A63B 69/08*** | (2006.01) |
| ***A63C 19/00*** | (2006.01) |
| ***A63G 3/00*** | (2006.01) |
| ***A63B 71/02*** | (2006.01) |
| *A63C 19/06* | (2006.01) |
| *E02B 5/00* | (2006.01) |
| *A63B 69/06* | (2006.01) |
| *E04H 4/00* | (2006.01) |

(56) References Cited

U.S. PATENT DOCUMENTS

| | | | | |
|---|---|---|---|---|
| 8,192,291 | B2 * | 6/2012 | Brassard | A63G 21/18 104/69 |
| 2002/0142851 | A1 | 10/2002 | Hunter | |
| 2005/0148398 | A1 * | 7/2005 | Lochtefeld | A63B 69/0093 472/117 |

FOREIGN PATENT DOCUMENTS

| | | | |
|---|---|---|---|
| EP | 0569499 | A1 | 11/1993 |
| FR | 2839328 | A1 | 11/2003 |
| FR | 2906287 | A1 | 3/2008 |
| JP | S54-169576 | U | 11/1979 |
| JP | H11-172757 | A | 6/1999 |
| JP | 2006-214244 | A | 8/2006 |

* cited by examiner

NON-PERMANENT WHITEWATER WATER COURSE

CROSS-REFERENCE TO RELATED APPLICATIONS

This application is the U.S. national stage of PCT/EP2016/057489 filed Apr. 6, 2016, which claims priority of German Patent Application 10 2015 105 496.5 filed Apr. 10, 2015 of which is hereby incorporated by reference in its entirety.

FIELD OF INVENTION

The present invention concerns aquatic activities and sports such as canoeing, kayaking or rafting, for which natural or artificial whitewater water courses are used, which make it possible for participants to train and compete.

BACKGROUND OF THE INVENTION

Water sports, such as canoeing, kayaking and rafting, may traditionally be practiced in natural rivers that may be equipped to define a specific course in the natural bed of the river. This requires little equipment, but the location is, by necessity, determined by the geographic situation of the river.

Alternatively, artificial rivers have been produced by deviating a portion of the flow of a river into an artificial canal, or achieved by pumping water into a pool. For example, whitewater stadia have been created in sites dedicated to the Olympic Games. In this case, the river beds were constructed of poured concrete, on embankments of appropriate shape, and the result is a very high cost of production and installation. Very little use is subsequently made of these whitewater stadia, so that the very high expense involved is generally considered excessive.

Moreover, EP document 0 569 499 B1 has already described a process and device for laying out a whitewater aquatic trail, consisting of providing, in the riverbed, holes that discharge out onto the upper surface of the bed, and placing, in the riverbed, components of obstacles, each of which has one part of an obstacle element and a mounting shaft that penetrates into one of the holes.

However, up to now, with currently known artificial rivers or whitewater stadia, the infrastructure made to support them cannot subsequently be removed, and its production cost is very high.

The problem proposed by the present invention is to design a means that makes it possible to significantly reduce the production and installation costs of a whitewater water course, and to simultaneously make it possible to dismantle the whitewater water course, transport it to another site, and assemble it for subsequent use at another site.

Another purpose of the invention is to make it possible to easily modify the shape of the riverbed and obstacles.

To achieve these goals and others, the invention proposes a whitewater water course, consisting of a riverbed that is capable of guiding a flow of water between an upper bed inlet and a lower bed outlet, and consisting of a means of water supply for introducing the flow of water into the upper bed inlet;

SUMMARY OF THE INVENTION according to the invention:

the riverbed is formed from a succession of individual bed modules, adjacent to each other, and assembled via their respective contact surfaces, the bed's individual modules are supported via a lower surface by a modular lattice support structure.

Thanks to the modular structure of the riverbed and the support structure, it becomes possible to construct the whitewater water course using prefabricated individual bed modules, which are lower in production cost, to transport the individual bed modules and support structure components from the production site to the utilization site, and assemble the individual bed modules and the support structure at low cost on the utilization site.

It also becomes possible to dismantle the whitewater water course after it has been used on the utilization site, to transport the individual bed modules and the support structure components from the utilization site to a subsequent site, and to reassemble the whitewater water course on the subsequent site for another use.

The individual bed modules may, advantageously, be molded components made of plastic material, for example a plastic material such as polyethylene or polyester.

In reality, the plastic material may, if necessary, be reinforced with fiberglass or other elements to increase mechanical resistance.

Individual bed modules may be formed from multiple components or may be one-piece. If they are formed from multiple components, they may be formed, for example, in two or three parts. If they are made in three parts, they consist, for example, of a lower branch limited by two opposing transverse contact surfaces and two opposing longitudinal contact surfaces, which also consist of two lateral branches limited by two opposing transverse contact surfaces, which comprise, among other things, a longitudinal contact zone bordering these surfaces and opposite to one of the longitudinal contact surfaces of the lower branch. In another manner of embodiment of the invention, the lower branch has only one longitudinal contact surface and one contact zone bordering its surface, and is opposite a longitudinal contact surface of the two lateral branches; the lateral branches are also limited by two opposing transverse contact surfaces. In another manner of embodiment of the invention, the lower branch has two opposing longitudinal contact zones bordering its surface, and they are opposite two longitudinal contact surfaces of the two lateral branches; the lateral branches are also limited by two opposing transverse contact surfaces.

Advantageously, the following can also be provided:

individual bed modules consist of blind holes that discharge out onto their upper surface guiding the flow of water, obstacle components each consist of an obstacle body that is integral to a fastening shaft, where the fastening shaft may be engaged selectively tightly in one of the three blind holes in the individual bed module.

In this way, obstacle components may be arranged in the riverbed, in order to adapt and modify the whitewater course as desired.

In practice, it is advantageous to provide blind holes that are identical to each other, and for the attachment shafts to be identical to each other, to make it possible to freely position the obstacle components into any of the blind holes in the individual bed modules.

This also makes it easier to change the path of the whitewater, for example between multiple successive events in a competition.

These types of blind-hole obstacles and penetrating shafts are described as examples:

Other means of moveable, interchangeable obstacles could be used, without deviating from the scope of the present invention:

Moreover, we may advantageously design the modular lattice support structure to consist of:

lower components which, when assembled, form a load distribution base designed to rest on the ground, upper groundways that are distributed under the lower surface of the individual bed modules, a lattice structure that connects the load distribution base to the upper groundways.

This type of arrangement makes it possible to easily adapt to the configuration of the general ground plan, and assures even support for the individual bed modules.

In order to facilitate the adaptation of the structure even further to a ground surface that might not be horizontal or flat, and in order to ensure adjustment of the level of the river bed, the lattice structure may advantageously comprise telescopic mountings for adjusting height.

According to one manner of embodiment that is adapted to form a whitewater stadium, the whitewater water course according to the invention may consist of:

at the upper inlet of the bed, an upper basin that receives the supply water, two lateral branches of the bed, which are generally parallel to each other and apart from each other, and which connect the upper basin to a middle basin located at an intermediate level between the upper inlet level of the bed and the lower outlet level of the bed, a central branch of the bed, which connects, between the lateral branches of the bed, the intermediate basin to a lower basin that forms the lower outlet of the bed.

In this way, the spectators may be distributed all around this assembly, while having a satisfactory view of the progress of the exercises or competitions. The upper basin serves as flow distribution areas for the two lateral branches of the bed, and reduces turbulence in the incoming water supply. The intermediate basin is used to dissipate energy at the inlet of the lateral branches of the bed, and supplies water to the central branch of the bed. The lower basin is used primarily as an inlet area, as a damping area for the water flow for the central branch of the bed, as a landing stage for the users, and as a pad basin for the water supply such as pumps.

In practice, the central branch of the bed may be of a width that is greater than that of the lateral branches of the bed. In this case, we can imagine competitions on parallel tracks, with two competitors simultaneously engaging on respective lateral bed branches, coming together in the intermediate basin and then crossing, elbow to elbow, the central bed branch down to the lower basin.

According to a first manner of embodiment, the individual bed modules may each form a section of the bed that occupies the entire width of the river bed, and whose width is less than or equal to the maximum authorized width of a typical road transport vehicle. In practice, this width is less than or equal to 2.50 m, in order to be compliant with the standard footprint of road vehicles in Europe.

In this case, individual bed modules may be transported on a road transport vehicle by being arranged so that the width of the road transport vehicle is located in the length of the road vehicle, and such that the length of the individual bed module is located along the width of the road vehicle.

In this first manner of embodiment, the successive individual bed modules are assembled via respective transverse contact surfaces.

Advantageously, each individual bed module may be limited by two opposing transverse contact surfaces, which are generally flat, and which may comprise a means of leakproofness to ensure watertightness of the jointure between the respective transverse contact surfaces of the adjacent individual bed modules when assembled, forming a bed segment of the whitewater water course.

The flat shape of the transverse contact surfaces facilitates modularity and interchangeability of the individual bed modules, which makes assembly easier and makes it possible to vary the shape of the river bed.

The means of leakproofness, because it is integrated into the transverse contact surfaces, also makes assembly easier for the construction of the whitewater water course, as well as disassembly for removal and subsequent transport of the whitewater water course to another site.

To make it even easier to modify the shape of the river beds, it is possible to plan for each individual bed module to have a shape that is selected from among a limited series of shapes of individual bed modules, with this series being limited to the shapes of individual bed module consisting of at least one shape that is a lateral branch of the individual bed module, and at least one shape that is a central branch of the individual bed module.

Due to the fact that the shapes of the individual bed modules are limited in number, the cost of producing molds is lower, since the same mold can be used multiple times in the manufacture of individual bed modules required for the production of a whitewater water course.

In practice, it is desirable to give the bed's lateral branches a non-straight shape, comprising curves and straight portions. To do this, the shapes of the individual module of the lateral bed branch may comprise at least one straight individual module shape, whose transverse contact surfaces are parallel to each other, and one curved individual module shape, whose transverse contact surfaces are angled relative to each other. We can note here that the curve may be transverse and/or vertical in nature.

According to a second manner of embodiment, we can also provide individual bed modules that are made of multiple components and comprise lateral individual bed modules, with an L-shaped transverse profile, and which occupy all or part of the half-width of the river bed, and which have a lower branch that is limited by two opposing transverse contact surfaces and by a longitudinal contact surface, and which have a lateral branch that is limited by two opposing transverse contact surfaces.

In this way, we can imagine individual bed modules, each of which has a smaller volume, which makes it possible to reduce the cost of manufacture of the molds, and which makes it possible to reduce the weight of each individual bed module to make handling them easier.

In a second manner of embodiment, we can advantageously provide the lateral individual bed modules with straight lateral individual modules, with transverse contact surfaces that are parallel to each other, and curved lateral individual modules, having transverse contact surfaces that are angled relative to each other.

These different shapes for the lateral individual modules make it possible to produce straight and curved segments for the river bed.

In a third manner of embodiment, we can provide individual bed modules can be made from multiple components and consist of three parts, i.e. a lower branch and two lateral branches, as defined above.

In both of the manners of embodiment described above, we can advantageously plan for leakproofness modules, made of elastically compressible material, placed between the contact surfaces and/or the contact zones of the adjacent individual bed modules, ensuring watertightness between the adjacent individual bed modules and permitting variations in orientation between the adjacent individual bed modules.

Other goals, characteristics and advantages of the present invention will become clear in the following description of specific manners of embodiment, made in relation to the attached figures, among which are:

Figure 1:
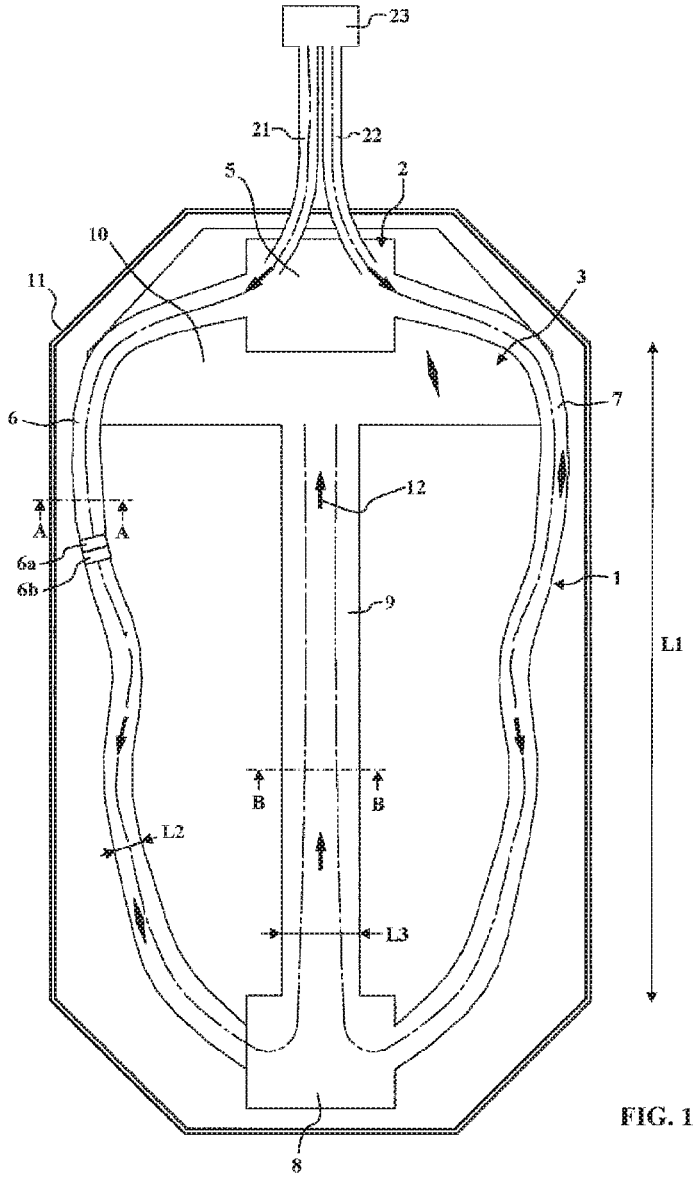
FIG. 1 illustrates, in a top view, a whitewater water course according to one manner of embodiment of the present invention, of the whitewater stadium type.
Figure 2:
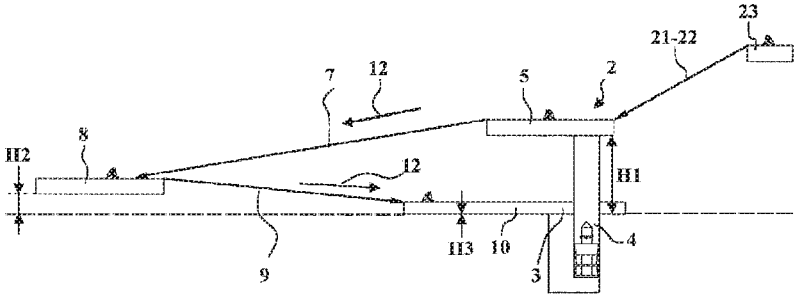
FIG. 2 is a schematic view of the side of the whitewater water course in FIG. 1.

In the manner of embodiment illustrated in FIGS. 1 and 2, a whitewater water course according to the invention comprises a river bed 1 that is able to guide a flow of water 12 between an upper bed inlet 2 and a lower bed outlet 3, and comprises a means of water supply 4 to introduce the flow of water 12 to the upper bed inlet 2.

In the embodiment illustrated in FIGS. 1 and 2, the river bed 1 comprises, at the upper bed inlet 2, an upper basin 5 that receives the water supply. Upper basin 5 is connected to two lateral bed branches 6 and 7, which are generally parallel to each other and separated from each other. Each lateral bed branch 6 and 7 connects one of the lateral ends of upper basin 5 to a respective lateral end of an intermediate basin 8, which itself is connected via its central part to a central branch of bed 9. The central bed branch 9 connects the intermediate basin 8 to the central part of a lower basin 10, forming the lower outlet of bed 3. Upper basin 5 is arranged above the lower basin 10, and at a distance L1 from the intermediary basin 8. Each of the lateral bed branches 6 and 7 has a mean width L2, whereas the central branch of bed 9 has a mean width L3 that is greater than the mean width L2 of the lateral bed branches 6 and 7.

Considering FIG. 2, we see that the intermediate basin 8 is located at an intermediate level H2 between the upper level H1 of the upper basin 5, forming the upper bed inlet 2 and the lower level H3 of the lower basin 5, forming the lower outlet of bed 3.

This type of whitewater water course illustrated in FIGS. 1 and 2 is particularly well adapted for construction of a whitewater stadium, limited by a polygonal contour 11 around which spectators may be distributed; these spectators will then all have good visibility of the events taking place on the whitewater course.

As an example, we can give the whitewater course the following dimensions: H1=5 m; H2=2 m; H3=0 m; L1=50 m; L2=2.50 m; L3=6 m. Simultaneously, we can plan for a flow of water 12 of from 5 to 6 m3/s.

Figure 3:
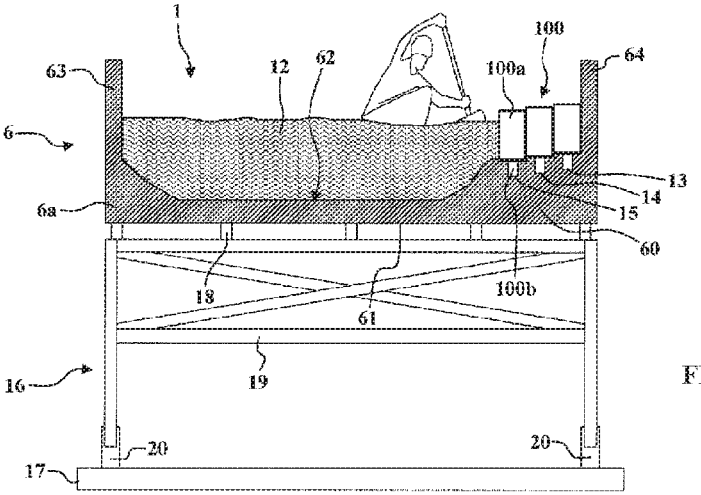
FIG. 3 is a partial transverse section view of the whitewater water course in FIG. 1, according to vertical plane A-A.

Let us consider FIG. 3, which illustrates the river bed in a transverse section view according to the lateral branch of bed 6, we see that the flow of water 12 is guided into an individual bed module 6*a* according to a first manner of embodiment, which is generally U-shaped facing upwards. The individual bed module 6*a* comprises a bottom wall 60 whose lower surface 61 is flat and whose upper surface 62 comprises blind holes such as holes 13, 14 and 15. Bottom wall 60 is connected to two lateral walls 63 and 64.

Blind holes 13, 14 and 15 are each designed for the selective attachment of a removable obstacle component 100. This type of obstacle component 100 comprises an obstacle body 100*a* that is connected to an attachment shaft 100*b*, where the attachment shaft 100*b* can be engaged selectively and tightly into one of the blind holes 13, 14 or 15 in an individual bed module 6*a*.

The individual bed module 6*a* is supported on its lower surface 61 by a modular lattice support structure 16. The modular lattice support structure 16 comprises lower components which, when assembled, form a load distribution base 17 that is designed to rest on the ground. The modular lattice support structure 16 also comprises upper groundways 18 that are oriented in the direction of the length of the lateral branch of bed 6, and which are distributed under the lower surface 61 of the individual bed module 6*a*. A lattice structure 19 connects the load distribution sole 17 to the upper groundways 18.

Telescoping mountings 20 make it possible to adjust the height of the lattice structure 19, in order to adjust the height of the individual bed module 6*a*.

As illustrated schematically in FIG. 1, the bed of river 1, for example in the lateral branch of bed 6, consists of a succession of individual bed modules, which are adjacent to each one after the other, and are assembled using the respective contact transverse surfaces. We can distinguish, for example, the two individual bed modules 6*a* and 6*b*, which are adjacent to each other when seen from above.

Figure 4:
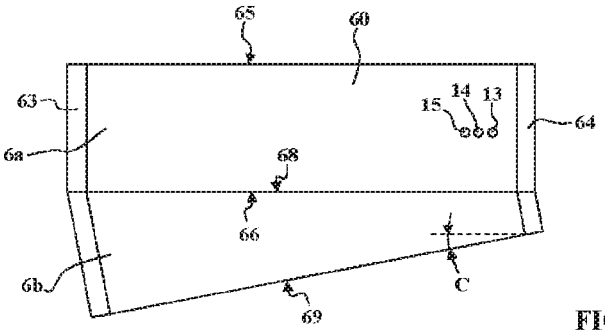
FIG. 4 is a top view showing the assembly of two successive individual bed modules, according to a first manner of embodiment adapted for a bed's lateral branch.

For further such ills, we now consider FIG. 4, which illustrates, in a larger scale, the individual bed modules 6*a* and 6*b* according to the first manner of embodiment. The individual bed module 6*a* is limited by two transverse contact surfaces 65 and 66, which are generally flat, and which are opposite each other.

Figure 5:
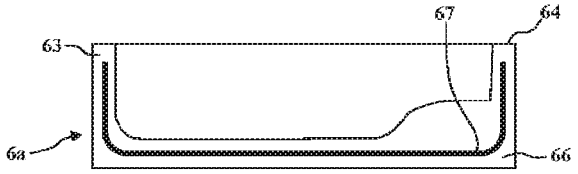
FIG. 5 is a front view showing an individual bed module with a means of leakproofness, according to this first manner of embodiment.

In FIG. 5, is illustrated in a front view, this same individual bed module 6*a*, and we can distinguish, on its transverse contact surface 66, a means of leakproofness 67 that ensures water tightness of the jointure between the respective transverse surfaces of the two adjacent bed modules when they are assembled to form the whitewater water course, for example as illustrated in FIG. 4.

The means of leakproofness 67 can, for example, be made of a continuous groove that connects the upper areas of the lateral walls 63 and 74, and in which an elastic seal or bead is inserted to form a water tightness joint that is compressed when two individual bed modules 6*a* and 6*b* are pressed against each other.

Returning to FIG. 4, we see that the individual bed module 6*a* seen from above is generally rectangular in shape, i.e. that its transverse contact faces 65 and 66 are parallel to each other. This type of individual bed module 6*a* is a straight individual module, i.e. it is adapted so that it constitutes a straight riverbed segment. On the other hand, the individual bed module 6*b* comprises transverse surfaces 68 and 69 which are at angles relative to each other, i.e. which are not parallel, but which form an angle C between them where C is not zero. One such individual bed module 6*b* is a curved individual module, i.e. it is adapted to produce a curved riverbed segment.

Figure 6:
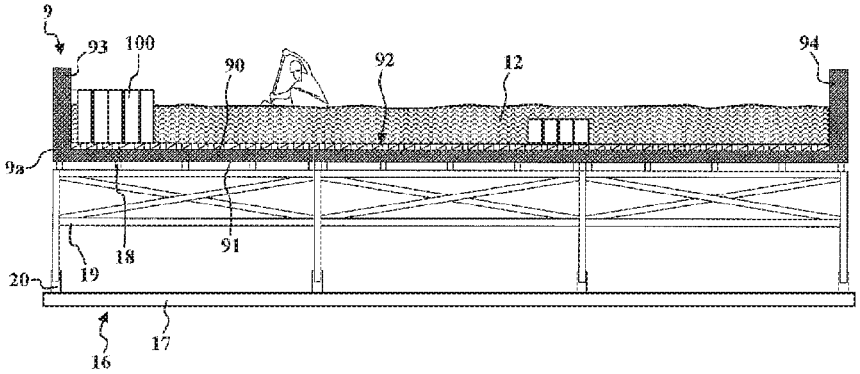
FIG. 6 is a partial transverse section view of the whitewater water course in FIG. 1, according to vertical plane B-B.

Let us now consider FIG. 6, which illustrates, in a transverse section view, the central bed branch 9 of FIG. 1. In a manner similar to that used to produce the lateral bed branches 6 and 7, central bed branch 9, in this first manner of embodiment, consists of a succession of individual bed modules such as module 9*a*. This individual bed module 9*a* comprises a bottom wall 90 with a flat lower surface 91 and with an upper surface 92, and consists of two lateral walls 93 and 94, which together form a structure in the shape of an open U with the opening at the top, to guide the flow of water 12. Similarly, as illustrated, we also provide blind holes that discharge onto the upper surface 92 and in which obstacle components 100 can be affixed; these obstacle components are moveable and interchangeable.

We also find, in FIG. 6, the lattice modular support structure 16, with the load distribution sole 17, upper groundways 18, lattice structure 19 and telescoping mounts 20 for regulating height.

Referring once again to FIGS. 1 and 2, we also distinguish, in the manner of embodiment illustrated, two start kayaks 21 and 22 which descend from a start platform 23 to an upper basin 5 respectively to the vicinity of the inlet of the two lateral bed branches 6 and 7.

Figure 7:
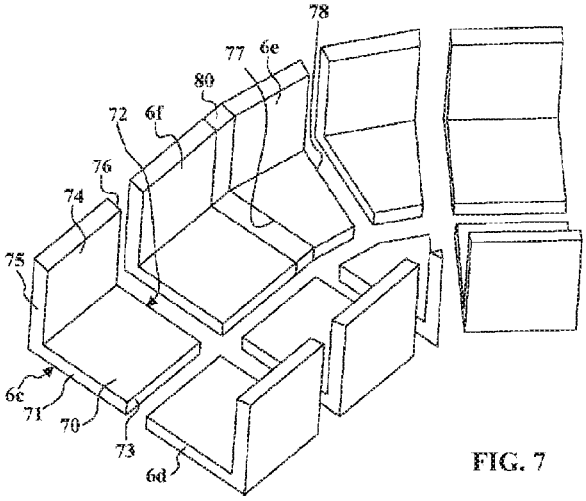
FIG. 7 is a perspective schematic view showing the assembly of multiple successive individual bed modules, according to a second manner of embodiment adapted for a lateral branch of the bed.

We shall now consider the second manner of embodiment illustrated schematically in FIG. 7.

In this second manner of embodiment, the individual bed modules consist of lateral individual bed modules, which have an L-shaped profile. For example, the individual bed module 6*c* consists of a lower branch 70 that is limited by two transverse contact surfaces 71 and 72 that are opposite each other, and by a longitudinal contact surface 73, and comprises a lateral branch 74 that is limited by two transverse contact surfaces 75 and 76 that are opposite each other. The lateral individual bed module 6*c* occupies all or part of the half-width of the riverbed to be made.

In FIG. 7, assembling the two lateral individual bed modules 6*c* and 6*d* which are identical and arranged symmetrically, making it possible to construct a riverbed segment, with each of the lateral individual bed modules 6*c* and 6*c* occupying the half-width of the riverbed.

It is possible, moreover, to introduce a parallelepiped separation module between the longitudinal contact surfaces 73 of the lateral individual bed modules 6*c* and 6*d*, so that the width of the riverbed made in this way can be adjusted as desired.

The lateral individual bed modules 6*c* and 6*d*, which comprise transverse contact surfaces 71 and 72 that are parallel to each other, are straight lateral individual modules that make it possible to produce straight riverbed segments.

In this second manner of embodiment, the curved riverbed segments may be made using curved lateral individual modules such as module 6*e*, whose transverse contact surfaces 77 and 78 are angled relative to each other.

In FIG. 7, we also see illustrated another manner of embodiment for the means of leakproofness between the different individual bed modules. This other manner of embodiment of the means of leakproofness may be used in either one of the manners of embodiment of the individual bed modules described previously.

In this case, leakproofness is assured by one of the leakproofness modules 80, made of elastically compressible material, and placed between the contact surfaces of the adjacent individual bed modules 6*e* and 6*f*. By compression, the leakproofness modules 80 provide leakproofness between the adjacent individual bed modules 6*e* and 6*f*, and they also offer the advantage of enabling variations in orientation between the adjacent individual bed modules 6*e* and 6*f*, without compromising leakproofness. In principle, the leakproofness modules 80 may, advantageously, be thin, in particular they may be thinner than what is shown in FIG. 7 which is schematically illustrated as an example. The contact surfaces of the adjacent individual bed modules 6*e* and 6*f* are structured so that they oppose the vertical displacement of the leakproofness modules 80 under the effect of the weight of the water.

The present invention is not limited to the methods of embodiment that were explicitly described above, but rather they include the diverse variations and generalizations contained in the claims below.

The invention claimed is:

1. An assembly for forming a white water river having a river bed for guiding a flow of water, the assembly comprising;

a modular lattice support structure;

a plurality of bed modules each bed module having a lower surface adapted to be supported by the lattice support structure, each bed module having at least one contact surface disposed adjacent to a contact surface of another of the plurality of bed modules when in an assembled position on the lattice support structure, the plurality of bed modules defining an upper bed inlet and a lower bed outlet;

wherein the lattice support structure includes:

a plurality of lower components which, when assembled, form a load distribution base designed to rest on the ground;

a plurality of upper groundways, distributed under the lower surface of the bed modules; and a lattice structure that connects the plurality of lower components to the plurality of upper groundways; and a water supply for delivering a flow of water at the upper bed inlet which flows to the lower bed outlet.

2. The assembly of claim 1 wherein each of the plurality of bed modules are molded components of a plastic material such as polyethylene or polyester.

3. The assembly of claim 1 wherein at least one of the modules comprises an upper surface guiding the flow of water, the upper surface having a plurality of blind holes extending downwardly from the upper surface; and at least one obstacle component having a body mounted to a fixation shaft, the shaft adapted to be received in one of the plurality of blind holes.

4. The assembly of claim 3 wherein each of the blind holes are identical to each other, and wherein each fixation shaft is identical to another to enable free positioning of the obstacle component in any one of the plurality of blind holes in the bed modules.

5. The assembly of claim 1 wherein the lattice structure comprises telescoping mountings for height adjustment.

6. The assembly of claim 1 further comprising;

an upper basin positioned at the upper inlet to receive the supply water; two lateral bed branches which are generally parallel to each other and apart from one another, and which connect the upper basin to an intermediate basin located at an intermediate level between the level of the upper bed inlet and the level of the lower bed outlet; and a central bed branch, which connects, between the lateral bed branches the intermediate basin to a lower basin that forms the lower bed outlet.

7. The assembly of claim 1 further comprising the bed modules each form a bed segment that occupies the width of the river bed, and whose length is no greater than a width of a ground transport vehicle.

8. The assembly of claim 7 wherein each individual bed module has a shape that is selected from a limited series of individual bed module shapes, where the limited series of individual bed module shapes consists of at least one lateral bed branch individual module shape, and at least one central bed branch individual module shape.

9. The assembly of claim 1 wherein the individual bed modules comprise lateral individual bed modules, with a transverse L-shaped profile, and occupy all or part of a half-width of the riverbed, and having a lower branch having two opposing transverse contact surfaces and a longitudinal contact surface, and having a lateral branch having two opposing transverse contact surfaces.

10. An assembly for forming a white water river having a river bed for guiding a flow of water, the assembly comprising;

a modular lattice support structure;

a plurality of bed modules each bed module having a lower surface adapted to be supported by the lattice support structure, each bed module having at least one contact surface disposed adjacent to a contact surface of another of the plurality of bed modules when in an assembled position on the lattice support structure, the plurality of bed modules defining an upper bed inlet and a lower bed outlet;

a water supply for delivering a flow of water at the upper bed inlet which flows to the lower bed inlet;

an upper basin positioned at the upper inlet to receive the supply water;

two lateral bed branches which are generally parallel to each other and apart from one another, and which connect the upper basin to an intermediate basin located at an intermediate level between the level of the upper bed inlet and the level of the lower bed outlet; and a central bed branch, which connects, between the lateral bed branches the intermediate basin to a lower basin that forms the lower bed outlet.

11. The assembly of claim 10 wherein the central bed branch has a width that is greater than the width of the lateral bed branches.

12. An assembly for forming a white water river having a river bed for guiding a flow of water, the assembly comprising;

a modular lattice support structure;

a plurality of bed modules each bed module having a lower surface adapted to be supported by the lattice support structure, each bed module having at least one contact surface disposed adjacent to a contact surface of another of the plurality of bed modules when in an assembled position on the lattice support structure, the plurality of bed modules defining an upper bed inlet and a lower bed outlet;

wherein the individual bed modules include lateral individual bed modules, with a transverse L-shaped profile, and occupy all or part of a half-width of the riverbed, and having a lower branch having two opposing transverse contact surfaces and a longitudinal contact surface, and having a lateral branch having two opposing transverse contact surfaces; and a water supply for delivering a flow of water at the upper bed inlet which flows to the lower bed outlet.

13. The assembly of claim 12 wherein the lateral individual bed modules comprise straight lateral individual modules with transverse contact surfaces that are parallel to each other, and curved lateral individual modules having transverse contact surfaces that are angled relative to each other.

14. The assembly of claim 12 further comprising leakproof modules, made of elastically compressible material, and placed between contact surfaces of adjacent individual bed modules, the leakproof modules providing a seal between the adjacent individual bed modules and enabling variation in an orientation between adjacent individual bed modules.

15. An assembly for forming a white water river having a river bed for guiding a flow of water, the assembly comprising;

a modular lattice support structure;

a plurality of bed modules each bed module having a lower surface adapted to be supported by the lattice support structure, each bed module having at least one contact surface disposed adjacent to a contact surface of another of the plurality of bed modules when in an assembled position on the lattice support structure, the plurality of bed modules defining an upper bed inlet and a lower bed outlet;

the bed modules each form a bed segment that occupies the width of the river bed, and whose length is no greater than a width of a ground transport vehicle;

each individual bed module being selected from at least one lateral bed branch individual module shape and at least one central bed branch individual module shape; and a water supply for delivering a flow of water at the upper bed inlet which flows to the lower bed outlet.

16. The assembly according to claim 15 wherein each bed module has two opposing transvers contact surfaces which are generally flat, and have a seal to provide watertightness at the jointure between the respective transverse contact surfaces of the adjacent individual bed modules when they are assembled, forming a bed segment of the whitewater river.

17. The assembly of claims 15 wherein the lateral bed branch individual module shapes comprising of at least one straight individual module shape, with transverse contact surfaces that are parallel to each other, and a curved individual module shape, with transverse contact surfaces that are at angles relative to each other.

* * * * *